US006241620B1

(12) United States Patent
Santa Cruz et al.

(10) Patent No.: US 6,241,620 B1
(45) Date of Patent: Jun. 5, 2001

(54) SIMULATED SHATTERED GLASS NOVELTY DEVICE AND METHOD OF USE

(76) Inventors: Cathy D. Santa Cruz, 7630 Tholl Dr., Reno, NV (US) 89506; Rick Fradella, 109 Caperna Ct., Boulder City, NV (US) 89005

( * ) Notice: Subject to any disclaimer, the term of this patent is extended or adjusted under 35 U.S.C. 154(b) by 0 days.

(21) Appl. No.: 09/501,846

(22) Filed: Feb. 10, 2000

(51) Int. Cl.[7] ..... A63G 31/00

(52) U.S. Cl. ..... 472/69; 472/51; 428/99; 428/15; 446/491

(58) Field of Search ..... 428/15, 98, 99; 472/69, 51; 446/491

*Primary Examiner*—Alexander S. Thomas

(57) ABSTRACT

A practical joke device which when removably mounted onto a glass surface of user choice, will create an illusion that an object has penetrated into the glass surface and the glass has been shattered.

7 Claims, 2 Drawing Sheets

SIMULATED SHATTERED GLASS NOVELTY DEVICE AND METHOD OF USE

FIELD OF THE INVENTION

This invention relates to gag or novelty devices that are used for practical jokes, but more particularly relates to such a device which is removably attachable onto a glass surface, such as a window or a windshield on a vehicle. Furthermore, when the device is installed and viewed by an onlooker, the device gives the illusion that an object has penetrated into the glass surface and the glass has been shattered.

BACKGROUND OF THE INVENTION

Novelty devices or gag devices have been known and used throughout history, as the general public always enjoys a good laugh. Such devices are commonly sold in stores and/or they are often seen in TV shows, such as the gold show "CANDID CAMERA". Furthermore some of these devices have become extremely well known, such as the famous "WHOOPIE CUSHION", or the "PET ROCK", etc.

There are hundreds of novelty items sold in stores everywhere each year and there are just as many patents on various novelty items. However, nowhere in the prior art did the applicants find a novelty item such as taught within the present application, wherein we provide a unique novelty item that creates an illusion of an object being embedded within a glass surface and the glass surface appears to be shattered.

SUMMARY OF THE INVENTION

It is therefore an object of the present invention to provide a unique simulated shattered glass novelty item that may be used as a gag device for humor purposes.

It is another object of the present invention to provide a simulated shattered glass novelty item that includes a central body member having multiple legs extending outwardly therefrom, with the central body member being of a shape that appears to be an object of engineering choice. For example, the central body member may appear to be a rock, a golf ball, a baseball, a dice, a casino chip, a bird, a fish, a hockey puck, etc.

Yet another object of the present invention is to provide a simulated shattered glass novelty item that is removably attachable onto a glass surface, such as onto a vehicle windshield, a glass window, a glass aquarium, or any other glass surface of user choice.

Still a further object of the present invention is to provide a simulated shattered glass novelty item that may be removably attached onto a glass surface by any suitable attachment means of engineering choice. For example, the legs may be made from a material that automatically clings or adheres to a glass surface, such as cling-VINYL. Another example may include the legs and central body member having suction cups. Yet another attachment means may include use of a clear silicone that is distributed onto the glass surface and the item is positioned thereon, or the like.

Also, a further object of the present invention is to provide a simulated shattered glass novelty item which when attached onto a glass surface will not damage or mar the glass surface in any manner.

Other objects and advantages will be seen when taken into consideration with the following specification and drawings.

DETAILED DESCRIPTION OF THE DRAWINGS

Referring now in detail to the drawings wherein like characters refer to like elements throughout the various views.

Figure 1:
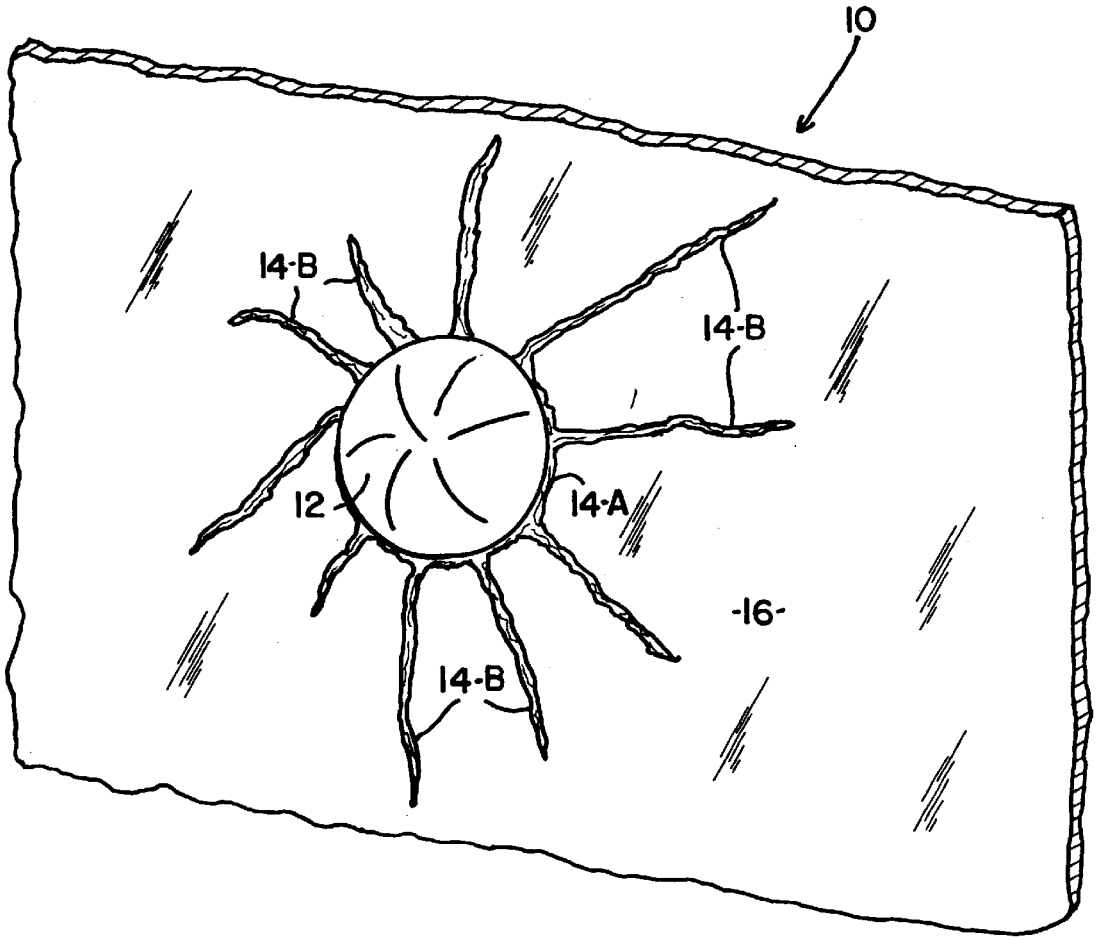
FIG. 1 is substantially a perspective overview of the preferred embodiment for the present invention.
Figure 2:
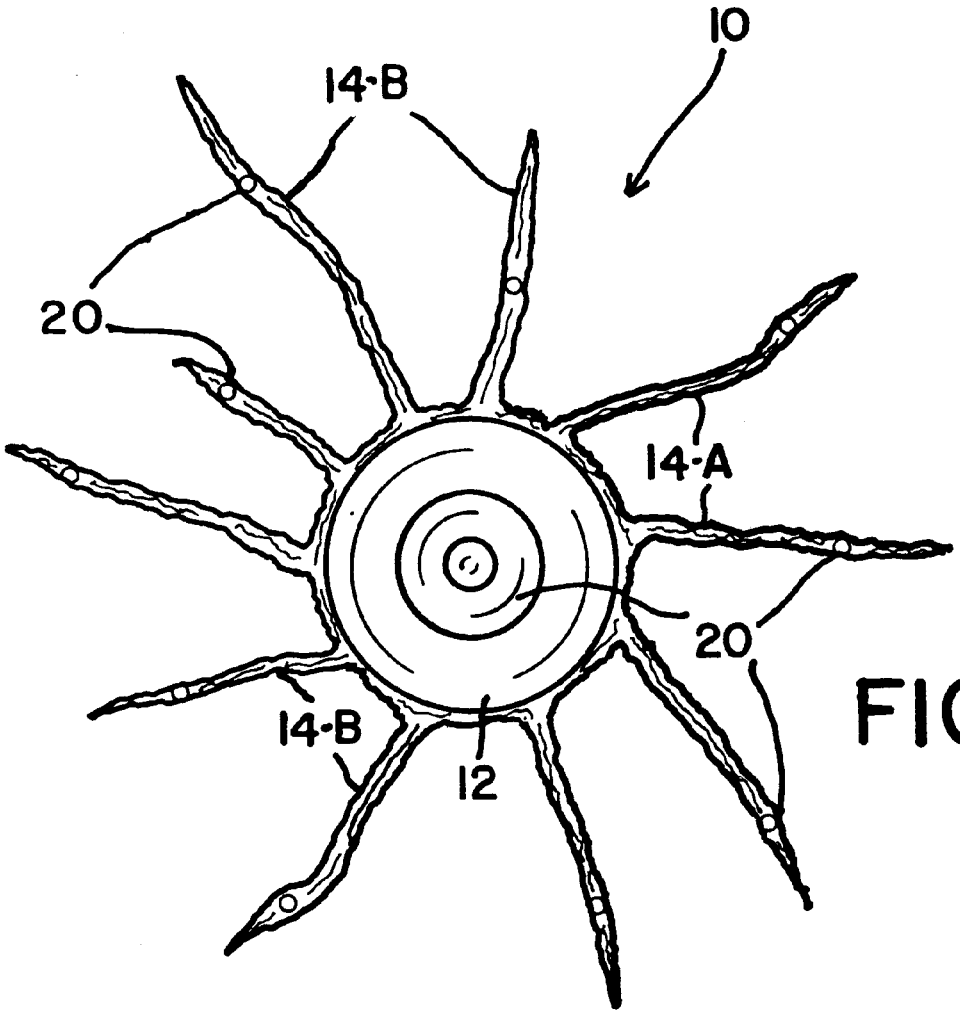
FIG. 2 is substantially a bottom view of the present invention including one type of attachment means.
Figure 3:
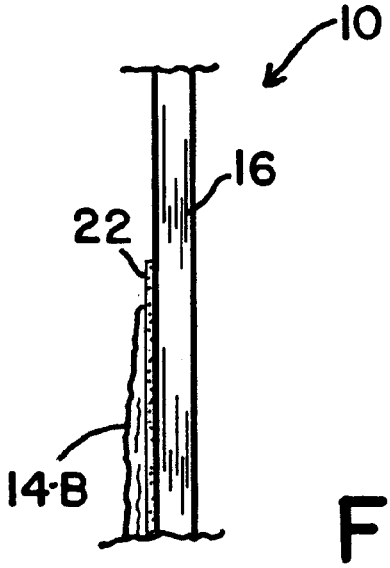
FIG. 3 is substantially a partial side view of the present invention when positioned on a glass surface and includes a different attachment means.

Within FIGS. 1–3 (arrow 10) substantially represents an overview of the present invention which is a simulated shattered glass novelty device that is used for practical jokes. The device is unique and novel as it may be used to create an illusion that an object has penetrated into and shattered a glass surface without actually damaging the glass surface in any manner, this is unlike any other prior art device the applicants are aware of.

It is to be understood the invention is not to be limited to the embodiment as herein shown, as many different types of embodiments may be produced without departing from the overall scope, concept, or the unusual results achieved by the present invention.

Referring now to FIG. 1 wherein we show the preferred embodiment for the present invention, with the simulated shattered glass novelty device (arrow 10) comprising a central body member (12) and an integrally formed base member (14-A). It is to be understood that central body member (12) is so constructed as to resemble an object of engineering choice. For example, central body member (12) can be in form of a rock, a golf ball, dice, a casino chip, a bird, a fish, a hockey puck, etc. The applicants contend that if the central body member (12) is to resemble a fish, it may be so constructed as to appear that half of the body has penetrated into the glass surface (16). This creates an illusion that the fish has broken through the glass surface (16) with the glass surface (16) being an aquarium. Likewise, if the central body member (12) is to resemble a bird, the bird may include feathers and it may appear as though half of the bird's body has penetrated into the glass surface (16), with the glass surface (16) being a vehicle windshield, or the like.

In FIG. 1, we show the central body member (12) being substantially in a form which resembles a ball, and the ball appears to have broken into and shattered the glass surface (16).

Central body member (12) and integrally formed base member (14-A) each include a flat surface. This not only allows Central body member (12) and integrally formed base member (14-A) to be easily mated together but this further allows the device to mounted in a flush manner onto the glass surface (16).

Central body member (12) further includes attachment means for attaching central body member (12) onto integrally formed base member (14). It is to be understood that any suitable attachment means of engineering choice may be used, such as glue, two-sided tape, or a fastener of the loop and pile variety, such as VELCRO. It is to be noted that if VELCRO is used, this is very advantageous as this allows the user to easily interchange different shaped central body member's (12)

Referring now to integrally formed base member (14-A) which is made from a translucent material of engineering choice, such as CLING-VINYL or the like, and includes multiple outwardly extending legs (14-B) . It is to be noted that integrally formed base member (14-A) may include any number of outwardly extending legs (14-B) according to engineering choice, and each of the outwardly extending legs (14-B) may be of any suitable shape or size of engineering choice. However, the applicants contend that the exterior edges of outwardly extending legs (14-B) are much more effective for imitating shattered glass if they are jagged and nonsymmetrical.

Integrally formed base member (14-A) includes attachment means for removably attaching integrally formed base member (14-A) onto glass surface (16). It is to be noted any suitable attachment means of engineering choice may be used. For example, in most cases being that the integrally formed base member (14-A) is made from a material such as CLING-VINYL, the integrally formed base member (14-A) will automatically attach or cling onto the glass surface (16) , thus no additional attachment means is necessary. However, if additional attachment means is desired, then a suitable attachment means may include integrally formed base member (14-A) having at least one, or multiple suction cups (20) thereon, as illustrated in FIG. 2.

Another suitable attachment means for removably attaching integrally formed base member (14-A) onto glass surface (16) may include the user manually depositing a thin layer of clear SILICONE (22) onto the glass surface (16), as illustrated in FIG. 3.

It will now be seen we have herein provided a unique novelty device, whereby when the central body member (12) and integrally formed base member (14-A) are positioned onto glass surface (16), central body member (12) appears to have penetrated into glass surface (16) and the outwardly extending legs (14-B) create the illusion that glass surface (16) has been shattered.

We further provide a method of using a simulated shattered glass novelty device comprising the following steps:

a. locating a glass surface (16) of user choice;

b. grasping a simulated shattered glass novelty device (arrow 10);

c. positioning simulated shattered glass novelty device (arrow 10) onto the glass surface (16); and;

d. pressing manually on simulated shattered glass novelty device (arrow 10) until simulated shattered glass novelty device (arrow 10) adheres onto glass surface (16).

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described the invention what we claim as new and wish to secure by Letters Patent is:

1. A simulated shattered glass novelty device comprising: a central body member and an integrally formed base member, said central body member having attachment means for attaching said central body member onto said integrally formed base member, said integrally formed base member having multiple outwardly extending legs, said integrally formed base member being made from a translucent material, and said integrally formed base member having attachment means for removably attaching said integrally formed base member onto a glass surface, whereby:

when said central body member and said integrally formed base member are positioned onto said glass surface, said central body member appears to have penetrated into said glass surface, and said outwardly extending legs create the illusion that said glass surface has shattered.

2. The simulated shattered glass novelty device of claim 1 wherein said attachment means for attaching said central body member onto said integrally formed base member is glue.

3. The simulated shattered glass novelty device of claim 1 wherein said attachment means for removably attaching said integrally formed base member onto said glass surface includes said integrally formed base member having at least one suction cup thereon.

4. The simulated shattered glass novelty device of claim 1 wherein said attachment means for removably attaching said integrally formed base member onto said glass surface is by manually depositing a thin layer of clear silicone onto said glass surface.

5. The simulated shattered glass novelty device of claim 1 wherein said glass surface is a vehicle windshield.

6. The simulated shattered glass novelty device of claim 1 wherein said glass surface is an aquarium.

7. A method of using a simulated shattered glass novelty device comprising the following steps:

e. locating a glass surface of user choice;

f. grasping a simulated shattered glass novelty device;

g. positioning said simulated shattered glass novelty device onto said glass surface; and;

h. pressing manually on said simulated shattered glass novelty device until said simulated shattered glass novelty device adheres onto said glass surface.

* * * * *